US008631933B2

(12) United States Patent
Lee et al.

(10) Patent No.: US 8,631,933 B2
(45) Date of Patent: Jan. 21, 2014

(54) BOTTLE CAP

(76) Inventors: Jeong-Min Lee, Seoul (KR); Seong-Jae Lee, Seoul (KR)

( * ) Notice: Subject to any disclaimer, the term of this patent is extended or adjusted under 35 U.S.C. 154(b) by 0 days.

(21) Appl. No.: 13/517,380

(22) PCT Filed: Aug. 10, 2009

(86) PCT No.: PCT/KR2009/004453

§ 371 (c)(1),
(2), (4) Date: Sep. 24, 2012

(87) PCT Pub. No.: WO2010/044539

PCT Pub. Date: Apr. 22, 2010

(65) Prior Publication Data

US 2013/0008808 A1 Jan. 10, 2013

(30) Foreign Application Priority Data

Oct. 14, 2008 (KR) ..... 10-2008-0101371
Oct. 15, 2008 (KR) ..... 10-2008-0102274

(51) Int. Cl.
*B65D 51/28* (2006.01)

(52) U.S. Cl.
USPC ..... 206/219

(58) Field of Classification Search
USPC ..... 206/219, 221, 222; 215/257, 250
See application file for complete search history.

(56) References Cited

U.S. PATENT DOCUMENTS 4,903,865 A * 2/1990 Janowitz ..... 222/83.5
6,116,445 A * 9/2000 Ikemori et al. ..... 215/301
6,705,462 B2 * 3/2004 Kasuya ..... 206/222
6,763,939 B2 * 7/2004 Alticosalian ..... 206/222
6,921,087 B2 * 7/2005 Takahashi et al. ..... 277/628
7,178,683 B2 * 2/2007 Birkmayer et al. ..... 215/257
2007/0193893 A1 * 8/2007 Lee et al. ..... 206/219
2008/0035497 A1 * 2/2008 Im ..... 206/219

FOREIGN PATENT DOCUMENTS

KR 10-2005-0002775 1/2005
KR 10-2005-0053573 6/2005
KR 10-2007-0081058 8/2007
KR 10-2008-0031699 4/2008

OTHER PUBLICATIONS

Search Report from PCT/KR2009/004453, dated May 28, 2010.

* cited by examiner

*Primary Examiner* — Steven A. Reynolds
*Assistant Examiner* — King M Chu
(74) *Attorney, Agent, or Firm* — Westman, Champlin & Koehler, P.A.

(57) ABSTRACT

A bottle cap containing different kinds of materials is coupled with a container inside an exterior material. The container is divided into a sealing portion coupled with a bottle neck and an operation part coupled with the exterior material. When the exterior material constituting the bottle cap is coupled with the bottle neck, the bottle cap is perpendicularly coupled to the bottle neck together with the container. Also, the side portion of the exterior material is sealed with a series of mechanical device along a screw thread or screw groove after the bottle cap is coupled with the bottle neck. When the exterior material is raised along the bottle neck by opening the bottle cap, materials stored in an inner storage space of the container fall into and are mixed inside the bottle.

15 Claims, 4 Drawing Sheets

BOTTLE CAP

CROSS-REFERENCE TO RELATED APPLICATION

This application is a Section 371 National Stage Application of International Application No. PCT/KR2009/004453, filed 10 Aug. 2009 and published as WO 2010/044539 on Apr. 22, 2010, not in English, the contents of which are hereby incorporated by reference in their entirety.

TECHNICAL FIELD

The present invention relates to a bottle cap including a container within an exterior material to contain a different material.

BACKGROUND ART

In the related art, a container is coupled to a bottle neck, and a material stored in an inner storage space of the container is dropped into a bottle and is mixed with a material stored in the bottle, while an exterior material constituting a bottle cap is opened. Such a technology is disclosed in Korean Patent Application No. 2004-0018636.

DISCLOSURE OF THE INVENTION

Technical Problem

In the related art, a stationary part of a container is fixed to a bottle neck, and an exterior material and an operation part are removed so that a material stored in a storage space can be dropped into a bottle and is mixed. In this case, since the stationary part is fixed perpendicularly to the bottle neck, frictional resistance occurs between the stationary part and the operation part.

At this point, sealing performance of the storage space is significantly degraded. Thus, it is substantially difficult to quickly couple a bottle cap to a bottle neck, which is not industrially applicable.

Such a bottle cap is disclosed in Korean Patent Application No. 10-2004-0018636. The present invention is provided to address the above-mentioned problems.

Technical Solution

To solve the above-mentioned problems, a bottle cap according to the present invention may be formed of a pure synthetic resin or a combination of a synthetic resin and a metal.

According to an embodiment of the present invention, a container formed of a synthetic resin is coupled to an exterior material formed of a metal material.

In this case, preferably, the exterior material may entirely cover the container. When the exterior material is held and opened to operate a bottle cap according to the current embodiment, a skirt is broken to drop a different material into a bottle, and the different material is mixed with a material stored in the bottle.

Preferably, the exterior material may securely fix a stationary part to a bottle neck, and be a roll on pilfer proof (ROPP) cap.

An operation part constituting the container may be adhered to an inner portion of the exterior material by an adhesive, or be mechanically coupled thereto, or be integrally molded thereto. The exterior material covers the bottle neck, and then, is processed by a series of devices of a capping machine (a sealing machine) to conform with a screw thread or screw groove of the bottle (the bottle neck).

The exterior material may be formed of a synthetic resin. In this case, while the exterior material is coupled to the bottle neck, the stationary part is fitted perpendicularly therein, and the exterior material is rotated along the screw thread. To allow the rotation of the exterior material, the exterior material is spaced apart from the container.

Alternatively, both an exterior material of a bottle cap and a sealing part as an interior material of the bottle cap may be coupled perpendicularly to a bottle neck. In this case, when the exterior material is rotated, a material stored in a storage space is dropped into an inner storage space of a bottle, and is mixed.

Advantageous Effects

According to the present invention, a stationary part of a bottle cap is coupled perpendicularly to a bottle neck, without rotating an operation part constituting a container, about the stationary part corresponding to the operation part. Particularly, when an exterior material of a bottle cap is formed of a metal material, a bottle neck is covered with the exterior material, and then, a sealing process is performed thereon. Thus, specifically in a technology requiring heat-resisting property, sealing performance of the bottle cap is significantly improved. In addition, the bottle cap is appropriate for a low pressure bottle.

In addition, since the metal exterior material is coupled to the bottle neck without resistance, and then, the metal exterior material is processed by a sealing machine to conform with a screw tread of the bottle, thereby improving joining and sealing performances between the bottle and the metal exterior material (a cover).

Also when the bottle cap is formed of a synthetic resin, the container can be rotatably coupled to an inner portion of the exterior material. For example, it is preferred that an assembling end of the container is coupled to a catching protrusion of the exterior material.

BEST MODE FOR CARRYING OUT THE INVENTION

Figure 1:
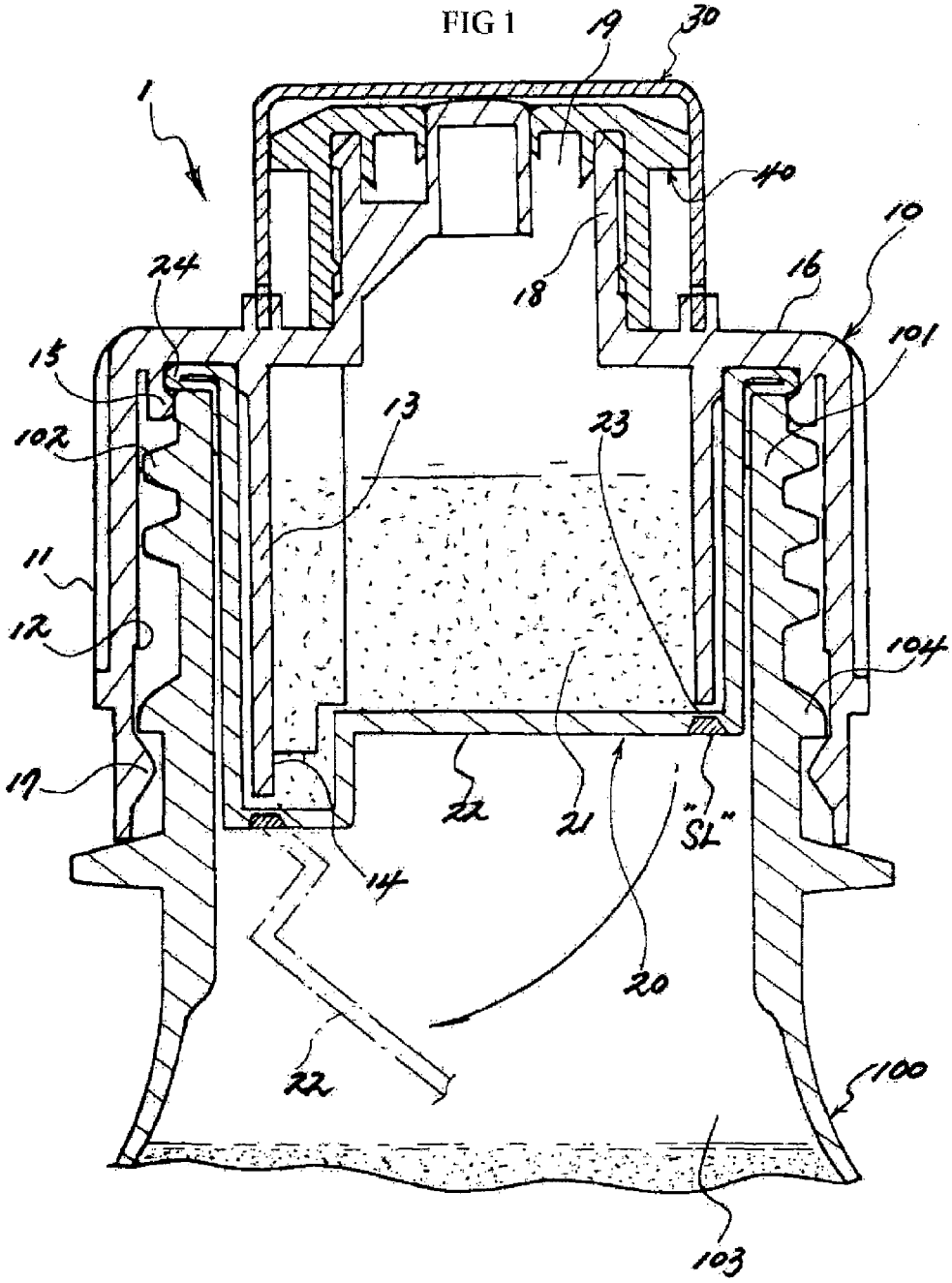
FIG. 1 is a cross-sectional view illustrating a container and a bottle cap coupled to a bottle neck, according to a first embodiment of the present invention.

A bottle cap according to an embodiment of the present invention will now be described with reference to the accompanying drawings. A bottle cap 1 for containing a different material includes: an exterior material 10 as an outer body to be coupled to a bottle neck 101 of a bottle 100; and a container 20 coupled to an inner portion of the exterior material 10.

The exterior material 10 includes an inner wall 12 on a side portion 11, and the inner wall 12 has no screw thread. Thus, the exterior material 10 is coupled to the bottle neck 101 without resistance between a bottle screw thread 102 and the inner wall 12.

The container 20 coupled to the inner portion of the exterior material 10 includes a storage space 21 and a sealing part 22 defined by a cutting line 23 to drop a material stored in the storage space 21.

The sealing part 22 has a recess in a portion corresponding to the cutting line 23 so that an end 14 of a long protrusion 13 of the exterior material 10 can efficiently performs a cutting operation from the recess as a reference location. It is preferred that the end 14 is disposed in the recess of the sealing part 22.

The container 20 is rotatably coupled to the inner portion of the exterior material 10. For example, it is preferred that an assembling end 24 of the container 20 is coupled to a catching protrusion 15 of the exterior material 10.

The bottle cap 1 as configured above is primarily coupled to the bottle neck 101 by a series of mechanical devices, as illustrated in FIG. 1. At this point, the outer circumference of the container 20 is fitted in an inner wall of the bottle neck 101, and the exterior material 10 is pressed and coupled to the bottle neck 101.

For reference, before a state as illustrated in FIG. 1, the bottle cap 1 is pressed downward and fitted on the bottle neck 101 without rotating the bottle cap 1. At this point, a top 16 of the exterior material 10 is slightly pressed using a series of mechanical devices. Accordingly, a catching protrusion 17 is moved over a bottle neck catching protrusion 104, and is fixed as illustrated in FIG. 1.

When the exterior material 10 of the bottle cap 1 is rotated (for example, counterclockwise) to operate the bottle cap 1, the end 14 breaks the cutting line 23 and pushes the sealing part 22 downward. Accordingly, a different material stored in the storage space 21 falls into a bottle storage space 103, and is mixed.

Then, a cover 30 is removed from the upper portion of the bottle cap 1, and an opening/closing part 40 is spaced upward from a spout 18, so that the materials mixed in the bottle storage space 103 can be discharged through a discharge hole 19.

Figure 2:
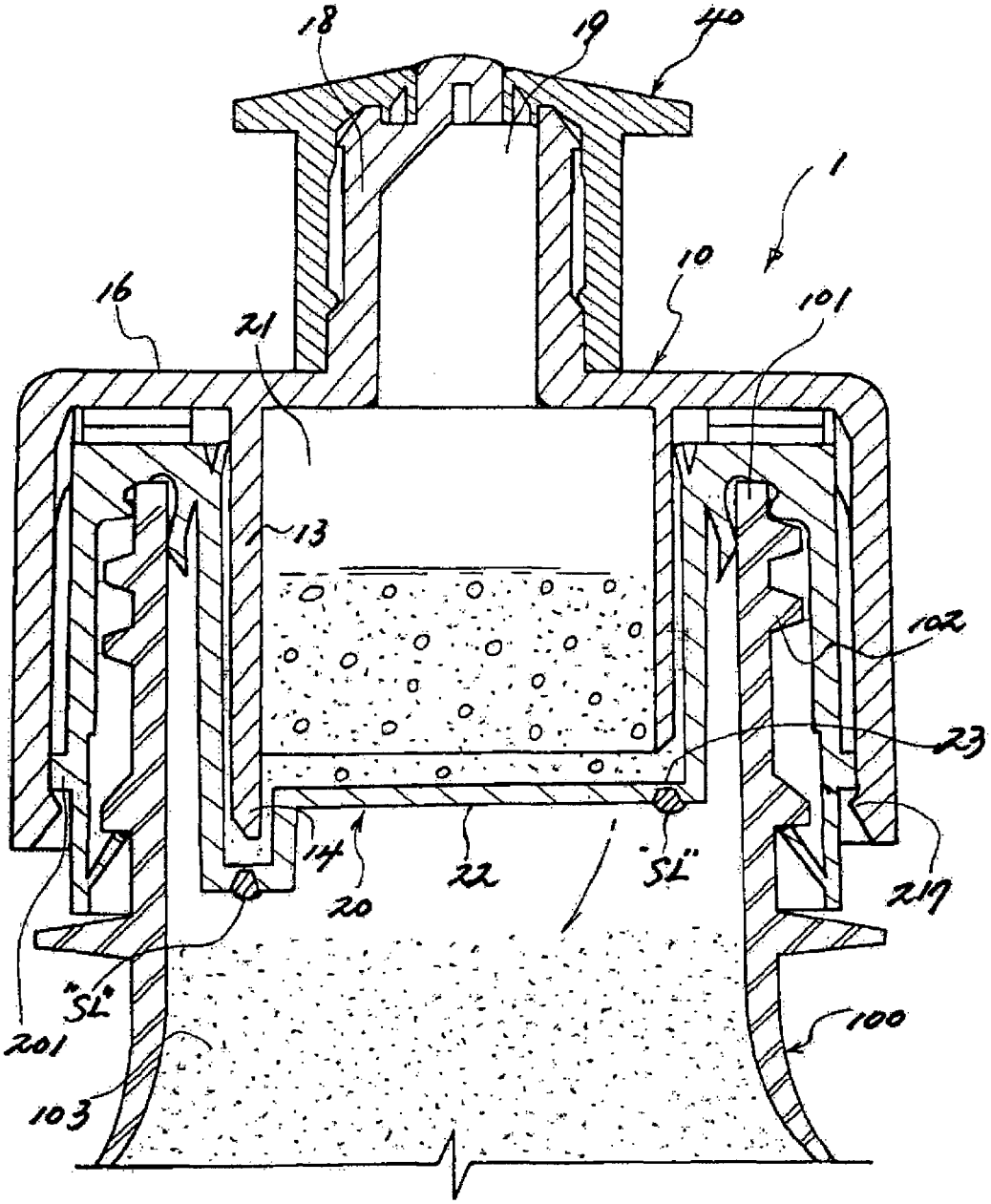
FIG. 2 is a cross-sectional view illustrating a bottle cap according to another embodiment of the present invention.

Referring to FIG. 2 according to another embodiment, a container 20 is disposed within an exterior material 10 and is perpendicularly coupled to a bottle neck 101, and the exterior material 10 coupled to an outer portion of the container 20 includes a catching protrusion 217 that is caught by a container catching protrusion 201. To assemble the bottle cap 1 and the bottle neck 101, when a top 16 of the exterior material 10 is pressed with the bottle cap 1 over the bottle neck 101, a container catching portion 202 is caught by an outer protrusion of the bottle neck 101 as illustrated in FIG. 2. Accordingly, the bottle cap 1 is placed on the bottle neck 101.

When the exterior material 10 is rotated to operate the bottle cap 1 in a state as illustrated in FIG. 2, an end 14 breaks a cutting line 23 to open a sealing part 22. Accordingly, a material stored in a storage space 21 falls into a bottle storage space 103, and is mixed with a material stored in the bottle storage space 103.

Then, an opening/closing part 40 is spaced upward from a spout 18, so that the materials mixed in the bottle storage space 103 can be discharged through a discharge hole 19.

Figure 3:
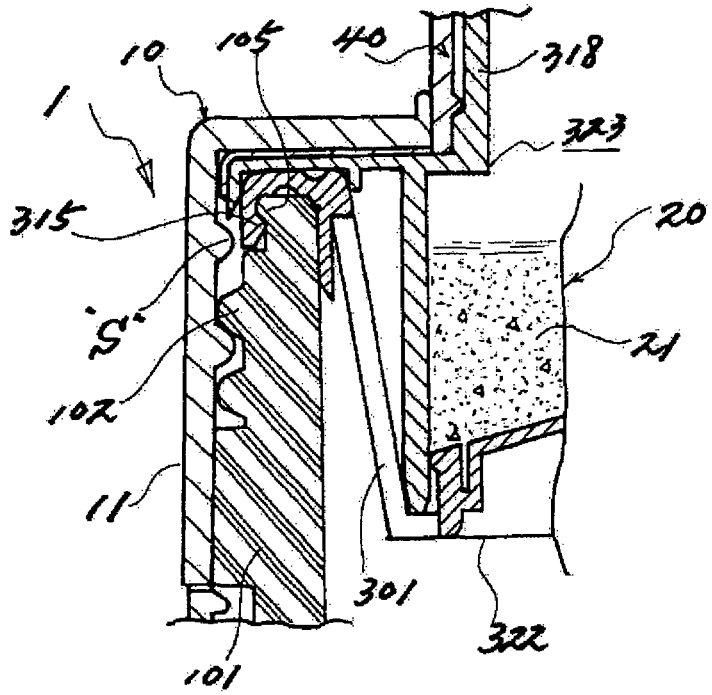
FIGS. 3 and 4 are cross-sectional views illustrating a principal part of a bottle cap according to another embodiment of the present invention.

Referring to FIG. 3 according to another embodiment, an exterior material 10 of a bottle cap 1 is screwed to a bottle neck 101, and includes a screw thread S on an inner wall of a side portion 11; and a container 20 is coupled to an inner portion of the exterior material 10, and is pressed and coupled to the bottle neck 101.

The container 20 coupled to the inner portion of the exterior material 10 can rotate with no traction, and the lower portion of an inner storage space 21 of the container 20 is sealed by a sealing part 322 provided with a drop space 301. Preferably, the sealing part 322 may be securely caught by the upper end of the screw thread S of the exterior material 10.

When the bottle cap 1 is coupled to the bottle neck 101, the container 20 is pressed substantially by the upper end and inner wall of the bottle neck 101, and is coupled thereto; and the exterior material 10 is rotated about the container 20, and is coupled to the bottle neck 101, as illustrated in FIG. 3.

In a state as illustrated in FIG. 3, when the exterior material 10 is removed from the container 20 fixed to the bottle neck 101, the screw thread S of the exterior material 10 upwardly moves an outer circumference 324 of an operation part 323. Accordingly, a different material stored in the inner storage space 21 is dropped into a bottle storage space via the drop space 301, and is mixed.

The mixed materials may be discharged through the drop space 301 or an opening/closing part 40 coupled to a spout 318. Preferably, a catching protrusion 315 of the container 20 may be caught by a ring-shaped protrusion 105 of the bottle neck 101.

Figure 4:
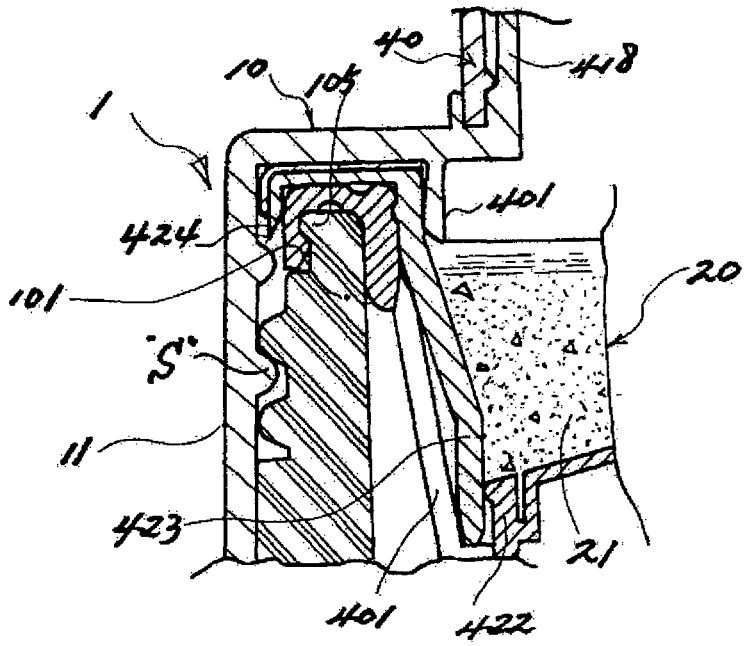

Referring to FIG. 4 according to another embodiment, a container 20 coupled to an inner portion of an exterior material 10 and allowed to rotate with no traction includes: a sealing part 422 fixed to a bottle neck 101; and an operation part 423 for sealing a storage space 21 of the sealing part 422. The sealing part 422 and the operation part 423 are assembled by an assembling part 401.

When a bottle cap 1 is coupled to the bottle neck 101, the container 20 is coupled perpendicularly to the bottle neck 101, and the exterior material 10 is screwed to the bottle neck 101. When the exterior material 10 is removed from the bottle neck 101, an outer circumference 424 is caught by a screw thread S disposed at the inner upper end of the exterior material 10, to thereby move the operation part 423 upward. Accordingly, a different material stored in the inner storage space 21 is dropped into a bottle storage space via a drop space 401, and is mixed.

The mixed materials may be discharged through the drop space 401 or a discharge hole formed by raising an opening/closing part 40 disposed above a spout 418.

The cutting line 23 as illustrated in FIGS. 1 and 2 may be provided with a supplementary line SL for improving a barrier performance. Preferably, the supplementary line SL may be formed of a soft silicone resin.

The opening/closing part 40 may include a rotation type or hinge type sealing cover. A method of forming and opening the storage space 21 of the container 20 may be varied in design.

Figure 5:
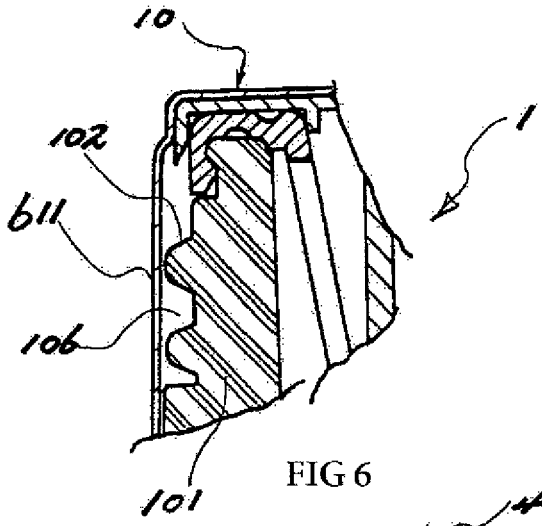
FIG. 5 is a cross-sectional view illustrating a principal part of a bottle cap before an exterior material and a bottle neck is completely assembled, according to another embodiment of the present invention.
Figure 6:
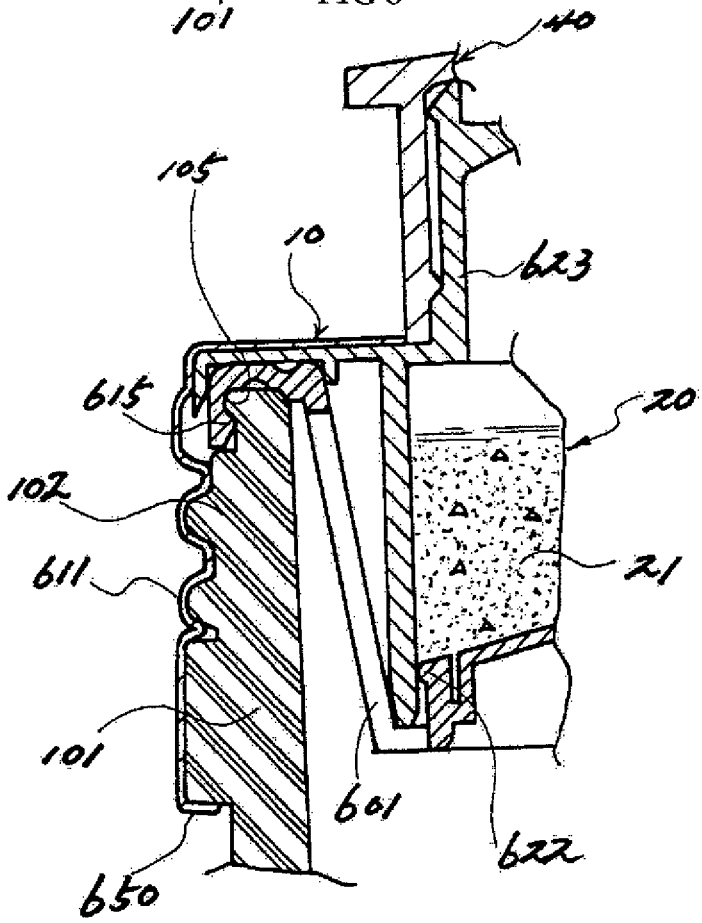
FIG. 6 is a cross-sectional view illustrating the principal part of FIG. 5 after the exterior material and the bottle neck is completely assembled by a series of devices.

Referring to FIGS. 5 and 6 according to another embodiment, a bottle cap 1 includes an exterior material 10 formed of a metal material. A container 20 is coupled to an inner portion of the exterior material 10, and then, the bottle cap 1 with a different material stored in an inner storage space 21 of the container 20 is placed over a bottle neck 101, as illustrated in FIG. 5. A side portion 611 of the exterior material 10 or a skirt 650 thereof is compressed using a series of mechanic devices such as a sealing machine such that the side portion 611 or the skirt 650 conforms with a bottle screw thread 102 of the bottle neck 101 or a bottle screw groove 106 thereof, as illustrated in FIG. 6.

Preferably, a method of coupling the bottle cap 1 to the bottle neck 101 is based on a method of coupling a roll on pilfer proof (ROPP) cap to a bottle neck. Since the method of coupling a ROPP cap to a bottle neck is well known in the art, a description thereof will be omitted.

An operation of the bottle cap 1 will now be described with reference to FIG. 6. When a user opens (rotates) the bottle cap 1, holding the side portion 611 of the exterior material 10, the skirt 650 is broken to allow an operation part 623 and the exterior material 10 to be removed from the bottle neck 101.

In this state, when the bottle cap 1 is further opened, the exterior material 10 is moved upward along the bottle screw thread 102 of the bottle neck 101. Accordingly, the operation part 623 is removed from a sealing part 622. At this point, the material stored in the inner storage space 21 is dropped into a bottle via a drop space 601, and is mixed. Even in this case, a catching protrusion 615 of the sealing part 622 is caught and fixed by a ring-shaped protrusion 105.

In this state, when the bottle is tilted, the mixed materials are discharged from the bottle via the drop space 601.

The mixed materials may be discharged via an opening/closing part 40. To this end, the exterior material 10 is coupled again to the bottle neck 101, and then, the opening/closing part 40 disposed above the exterior material 10 is moved upward.

For reference, a ROPP cap is formed through a plate making process, a painting process, a printing process, a cutting process, and a pressing process. Thus, it is preferred that the above processes for a ROPP cap is performed on the exterior material 10 formed of a metal material, and the operation part 623 is adhered or securely coupled to the exterior material 10 to form an integrated structure, thereby improving operation efficiency thereof.

INDUSTRIAL APPLICABILITY

The bottle cap of the present invention can be used to add various materials such as extracts or powders to various products such as special drinks, special water, and wines. In addition, the bottle cap of the present invention can be used to separately store chemicals or household items and mixing the chemicals or household items. Preferably, the bottle cap of the present invention that can store a different material may be used in a state where the bottle cap is firmly fixed to a bottle neck, and the bottle cap can be used for the purpose of improving sealing.

The invention claimed is:

1. A bottle cap for containing a different material, comprising:

an exterior material formed of a metal material; and a container formed of a synthetic resin, and coupled to an inner portion of the exterior material, wherein:

the container comprises a sealing part coupled to a bottle neck of a bottle, and an operation part coupled to the exterior material;

the exterior material is coupled perpendicularly to the bottle neck, together with the container;

after the bottle cap is coupled to the bottle neck, a side portion of the exterior material is sealed by a series of mechanical devices to conform with a screw thread or screw groove of the bottle neck;

the operation part is disposed on a lower portion of a top of the exterior material, and has a tubular shape with a storage space;

the sealing part is coupled substantially to the tubular shape of the operation part to seal the storage space storing a material; and when the bottle cap is opened, the exterior material is moved upward along the bottle neck, and the material stored in the storage space is dropped into the bottle, and is mixed.

2. The bottle cap of claim 1, wherein the exterior material covers at least one of the container; and when the exterior material is opened to operate the bottle cap, a skirt is broken so that the material stored in the inner storage space is dropped into the bottle, and the operation part is removed from the sealing part.

3. The bottle cap of claim 1, wherein the container is accommodated in the exterior material, and is provided with a catching protrusion (a coupling part) to securely fix the sealing part as a portion of the container, to the bottle neck.

4. The bottle cap of claim 1, wherein the operation part is coupled substantially to the lower portion of the top of the exterior material.

5. The bottle cap of claim 4, wherein the operation part is coupled to the lower portion by an adhesive or through molding.

6. The bottle cap of claim 1, wherein after the exterior material covers the bottle neck, a series of devices of a capping machine (a sealing machine) forms a screw thread or screw groove on the exterior material.

7. The bottle cap of claim 1, wherein after the exterior material covers the bottle neck, a screw thread or screw groove is formed on the exterior material, or the exterior material is curled in a circular shape.

8. The bottle cap of claim 1, wherein when the sealing part is fixed to the bottle neck, a catching protrusion is fixed to a ring-shaped protrusion of the bottle neck so as to prevent the sealing part from being removed from the bottle neck.

9. The bottle cap of claim 1, wherein the exterior material is formed through a plate making process, a painting process, a printing process, a cutting process, and a pressing process, and then, a part for containing various different materials is coupled, adhered, or molded to the exterior material.

10. The bottle cap of claim 1, wherein the sealing part closes the storage space of the operation part.

11. The bottle cap of claim 1, wherein the exterior material is coupled to the bottle neck in a manner of a roll on pilfer proof (ROPP) cap.

12. The bottle cap of claim 1, wherein an opening/closing part is disposed over the operation part to discharge the mixed material from the bottle.

13. The bottle cap of claim 12, wherein the opening/closing part is moved upward to open a discharge hole.

14. A bottle cap that is fitted on a bottle neck having a screw thread or screw groove on an outer portion thereof, the bottle cap comprising:

an exterior material formed of a metal material; and a container for containing a different material, which is coupled to an inner portion of the exterior material;

wherein:

after the bottle cap covers the bottle neck of a bottle, a side portion of the exterior material is sealed by a series of mechanical devices to conform with the screw thread or screw groove of the bottle neck;

an operation part is disposed on a lower portion of a top of the exterior material, and has a tubular shape with a storage space therein;

a sealing part is coupled to the operation part and is disposed under a stationary part to seal the storage space; and when the exterior material as a portion of the bottle cap is opened, the sealing part constituting the container is fixed to the bottle neck, and the exterior material and an operation part coupled to the sealing part are opened by the screw thread of the bottle neck and the sealing part is removed from the stationary part so that a material stored in the storage space of the operation part is dropped into the bottle via a drop space disposed inside the stationary part, and is mixed.

15. The bottle cap of claim 14, wherein the operation part is coupled to the exterior material by an adhesive or through molding.

* * * * *